US009732620B2

(12) United States Patent
Hough

(10) Patent No.: US 9,732,620 B2
(45) Date of Patent: Aug. 15, 2017

(54) SNAP IN PLATFORM DAMPER AND SEAL ASSEMBLY FOR A GAS TURBINE ENGINE

(71) Applicant: United Technologies Corporation, Hartford, CT (US)

(72) Inventor: Matthew A. Hough, West Hartford, CT (US)

(73) Assignee: United Technologies Corporation, Farmington, CT (US)

( * ) Notice: Subject to any disclaimer, the term of this patent is extended or adjusted under 35 U.S.C. 154(b) by 403 days.

(21) Appl. No.: 14/339,019

(22) Filed: Jul. 23, 2014

(65) Prior Publication Data

US 2016/0153303 A1 Jun. 2, 2016

Related U.S. Application Data

(60) Provisional application No. 61/882,981, filed on Sep. 26, 2013.

(51) Int. Cl.

| | |
|---|---|
| ***F01D 11/00*** | (2006.01) |
| ***F01D 5/22*** | (2006.01) |
| ***F01D 5/30*** | (2006.01) |
| *F01D 5/32* | (2006.01) |

(52) U.S. Cl.

CPC ..... *F01D 11/006* (2013.01); *F01D 5/22* (2013.01); *F01D 5/3007* (2013.01); *F01D 5/323* (2013.01); *F05D 2260/96* (2013.01)

(58) Field of Classification Search

CPC ..... F01D 5/22; F01D 5/225; F01D 11/006

See application file for complete search history.

(56) References Cited

U.S. PATENT DOCUMENTS

| | | | | |
|---|---|---|---|---|
| 6,932,575 | B2 * | 8/2005 | Surace | F01D 5/22 416/193 A |
| 7,121,800 | B2 | 10/2006 | Beattie | |
| 7,918,265 | B2 | 4/2011 | Verner et al. | |
| 8,011,892 | B2 | 9/2011 | Ramlogan et al. | |
| 8,167,566 | B2 | 5/2012 | Howes | |
| 8,393,869 | B2 | 3/2013 | Kim et al. | |
| 2003/0044284 | A1 | 3/2003 | Leeke et al. | |
| 2004/0086387 | A1 | 5/2004 | Fitts et al. | |
| 2005/0095129 | A1 | 5/2005 | Benjamin et al. | |
| 2006/0056975 | A1 | 3/2006 | Honkomp et al. | |
| 2009/0004013 | A1 | 1/2009 | Ramlogan et al. | |

* cited by examiner

*Primary Examiner* — Kenneth Bomberg
*Assistant Examiner* — John Hunter
(74) *Attorney, Agent, or Firm* — O'Shea Getz P.C.

(57) ABSTRACT

A turbine assembly includes a first turbine blade circumferentially adjacent to a second turbine blade. The first turbine blade includes a first platform with a first underplatform surface. The second turbine blade includes a second platform with a second underplatform surface. The first underplatform surface and the second underplatform surface at least partially defines a cavity. A damper with a platform rub surface is included adjacent the first underplatform surface and the second underplatform surface. A seal is included with a forward portion, an aft portion, and a damper interface portion therebetween. The damper interface portion extends along a damper underside and the forward portion and the aft portion adjacent the first underplatform surface and the second underplatform surface.

8 Claims, 8 Drawing Sheets

SNAP IN PLATFORM DAMPER AND SEAL ASSEMBLY FOR A GAS TURBINE ENGINE

CROSS-REFERENCE TO RELATED APPLICATION

This application claims priority to U.S. Patent Application No. 61/882,981 filed Sep. 26, 2013, which is hereby incorporated herein by reference in its entirety.

STATEMENT REGARDING FEDERALLY SPONSORED RESEARCH OR DEVELOPMENT

This disclosure was made with Government support under FA8650-09-D-2923 0021 awarded by the United States Air Force. The Government may have certain rights in this disclosure.

BACKGROUND

This application relates generally to a turbine seal and damper assembly and, more particularly, to a stiffer seal and damper assembly.

Gas turbine engines, such as those that power modern commercial and military aircraft, generally include a compressor to pressurize an airflow, a combustor to burn a hydrocarbon fuel in the presence of the pressurized air, and a turbine to extract energy from the resultant combustion gases.

The turbine section includes rotatable turbine blade and stationary turbine vane arrays. Each of the turbine blades is spaced apart from an adjacent turbine blade to accommodate movement and expansion during operation. The turbine blades typically each include a root that attaches to the rotor, a platform and an airfoil that extends radially outwardly from the platform.

Hot combustion gases that flow over the platform are prevented from leaking between adjacent turbine blades by a seal as components below the platform are generally not designed to operate for extended durations exposed to the elevated temperatures of the hot combustion gases. In addition to the seal, a damper between adjacent turbine blades dissipates vibration through frictional contact between the damper and an underplatform surface of the turbine blade platform.

When a ratio between the airfoil tip deflections and platform deflections are high, however, the platform damper may be placed close to the underplatform and the seal passes through the damper. Although effective in historical damping systems, the damper stiffness may not be sufficient for certain engine architectures.

SUMMARY

A damper-seal assembly for a turbine blade, according to one disclosed non-limiting embodiment of the present disclosure, includes a damper with a platform rub surface and a multiple of retention features opposite thereto. The damper-seal assembly also includes a seal engaged with the retention features.

In a further embodiment of the present disclosure, the platform rub surface is continuous.

In a further embodiment of any of the foregoing embodiments of the present disclosure, the multiple of retention features includes a nub.

In a further embodiment of any of the foregoing embodiments of the present disclosure, the seal includes an aperture to receive the nub.

In a further embodiment of any of the foregoing embodiments of the present disclosure, the multiple of retention features includes a forward tang and an aft tang to engage an edge of the seal.

In a further embodiment of any of the foregoing embodiments of the present disclosure, the forward tang and the aft tang are generally L-shaped.

A turbine assembly, according to another disclosed non-limiting embodiment of the present disclosure, includes a first turbine blade circumferentially adjacent to a second turbine blade. The first turbine blade includes a first platform with a first underplatform surface. The second turbine blade includes a second platform with a second underplatform surface. The first underplatform surface and the second underplatform surface at least partially define a cavity. The turbine assembly also includes a damper with a platform rub surface adjacent the first underplatform surface and the second underplatform surface. The turbine assembly also includes a seal with a forward portion, an aft portion, and a damper interface portion therebetween. The damper interface portion extends along a damper underside and the forward portion and the aft portion adjacent the first underplatform surface and the second underplatform surface.

In a further embodiment of any of the foregoing embodiments of the present disclosure, the platform rub surface is continuous.

In a further embodiment of any of the foregoing embodiments of the present disclosure, the damper includes a multiple of retention features opposite the platform rub surface. The seal is engaged with the retention features.

In a further embodiment of any of the foregoing embodiments of the present disclosure, the multiple of retention features includes a nub.

In a further embodiment of any of the foregoing embodiments of the present disclosure, the seal includes an aperture to receive the nub.

In a further embodiment of any of the foregoing embodiments of the present disclosure, the multiple of retention features includes forward tang and an aft tang to engage an edge of the seal.

In a further embodiment of any of the foregoing embodiments of the present disclosure, the forward portion may be at least partially supported on a ledge defined within the cavity.

In a further embodiment of any of the foregoing embodiments of the present disclosure, the aft portion extends axially rearward and inboard to conform with the first underplatform surface and the second underplatform surface.

A method of assembling a first turbine blade circumferentially adjacent to a second turbine blade is provided according to another disclosed non-limiting embodiment of the present disclosure. The first turbine blade includes a first platform with a first underplatform surface. The second turbine blade includes a second platform with a second underplatform surface. The first underplatform surface and the second underplatform surface at least partially defines a cavity. The method includes positioning a damper with a continuous platform rub surface adjacent to the first underplatform surface and the second underplatform surface such that the damper is between a seal and the first underplatform surface and the second underplatform surface.

In a further embodiment of any of the foregoing embodiments of the present disclosure, the method includes retaining the seal to the damper.

In a further embodiment of any of the foregoing embodiments of the present disclosure, the method includes axially retaining the seal to the damper.

In a further embodiment of any of the foregoing embodiments of the present disclosure, the method includes contacting the continuous platform with the first underplatform surface and the second underplatform surface.

In a further embodiment of any of the foregoing embodiments of the present disclosure, the method includes contacting a forward portion and an aft portion of the seal with the first underplatform surface and the second underplatform surface.

In a further embodiment of any of the foregoing embodiments of the present disclosure, the method includes retaining a damper interface portion between the forward portion and the aft portion of the seal to the damper. The damper interface portion not in contact with the first underplatform surface and the second underplatform surface.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
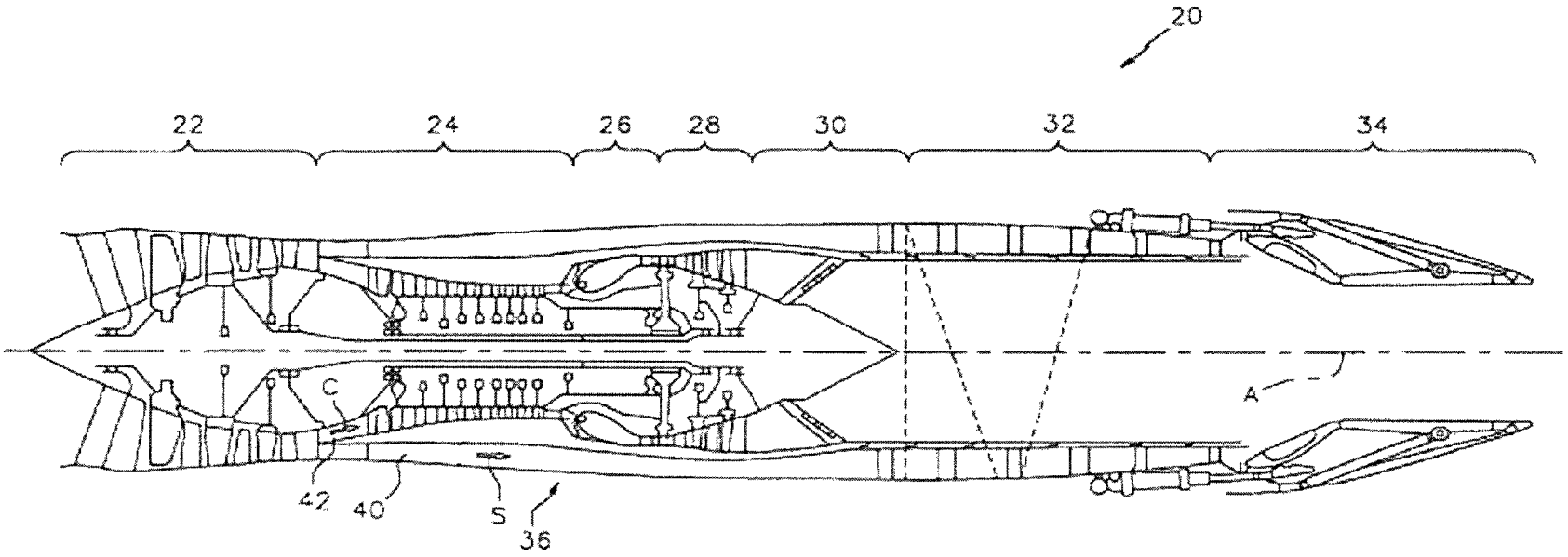
FIG. 1 is a schematic cross-section of one example aero gas turbine engine.

FIG. 1 schematically illustrates a gas turbine engine 20. The gas turbine engine 20 is disclosed herein as a two-spool low-bypass augmented turbofan that generally incorporates a fan section 22, a compressor section 24, a combustor section 26, a turbine section 28, an augmenter section 30, an exhaust duct section 32, and a nozzle system 34 along a central longitudinal engine axis A. Although depicted as an augmented low bypass turbofan in the disclosed non-limiting embodiment, it should be understood that the concepts described herein are applicable to other gas turbine engine architectures to include non-augmented engines, geared architecture engines, direct drive turbofans, turbojet, turboshaft, multi-stream variable cycle adaptive engines and other engine architectures. Variable cycle gas turbine engines power aircraft over a range of operating conditions and essentially alters a bypass ratio during flight to achieve countervailing objectives such as high specific thrust for high-energy maneuvers yet optimizes fuel efficiency for cruise and loiter operational modes.

An engine case structure 36 defines a generally annular secondary airflow path 40 around a core airflow path 42. Various case structures and modules may define the engine case structure 36 that essentially defines an exoskeleton to support the rotational hardware.

Air that enters the fan section 22 is divided between a core airflow through the core airflow path 42 and a secondary airflow through a secondary airflow path 40. The core airflow passes through the combustor section 26, the turbine section 28, then the augmentor section 30 where fuel may be selectively injected and burned to generate additional thrust through the nozzle system 34. It should be appreciated that additional airflow streams such as third stream airflow typical of variable cycle engine architectures may additionally be sourced from the fan section 22.

The secondary airflow may be utilized for a multiple of purposes that include, for example, cooling and pressurization. The secondary airflow as defined herein may be any airflow different from the core airflow. The secondary airflow may ultimately be at least partially injected into the core airflow path 42 adjacent to, for example, the exhaust duct section 32 and the nozzle system 34.

The exhaust duct section 32 may be circular in cross-section as typical of an axisymmetric augmented low bypass turbofan or may be non-axisymmetric in cross-section to include, but not be limited to, a serpentine shape to block direct view to the turbine section 28. In addition to the various cross-sections and the various longitudinal shapes, the exhaust duct section 32 may terminate in a Convergent/Divergent (C/D) nozzle system, a non-axisymmetric two-dimensional (2D) C/D vectorable nozzle system, a flattened slot nozzle of high aspect ratio or other nozzle arrangement.

Figure 2:
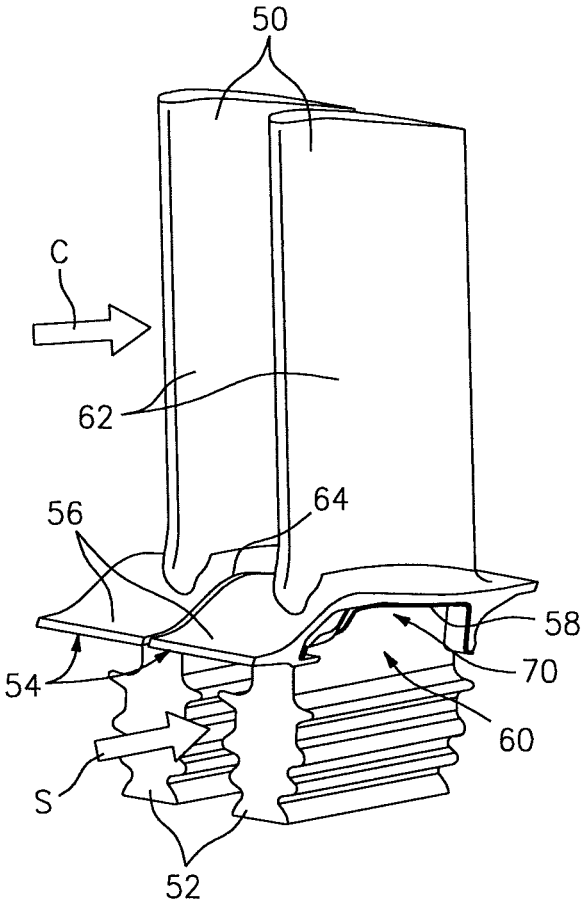
FIG. 2 is a perspective view of a damper seal assembly within the turbine blade.

With reference to FIG. 2, the turbine section 28 includes an array of turbine blades 50 (only two shown). Each of the turbine blades 50 includes a root 52 that is fit into a radial slot of a turbine rotor (not shown). Radially outward of the root 52 is a platform 54 that includes a platform outer surface 56 and an underplatform surface 58. The underplatform surface 58 is disposed radially inward of the outer surface 56 to at least partially surround a cavity 60. An airfoil 62 extends from the platform 54.

Core combustion gases (illustrated schematically by arrow C) flow around the airfoil 62 and over the outer surface 56 while the secondary airflow (illustrated schematically by arrow S) flows into cavity 60. A gap 64 extends axially between adjacent turbine blades 50. The gap 64 minimizes contact between the turbine blades 50.

Figure 3:
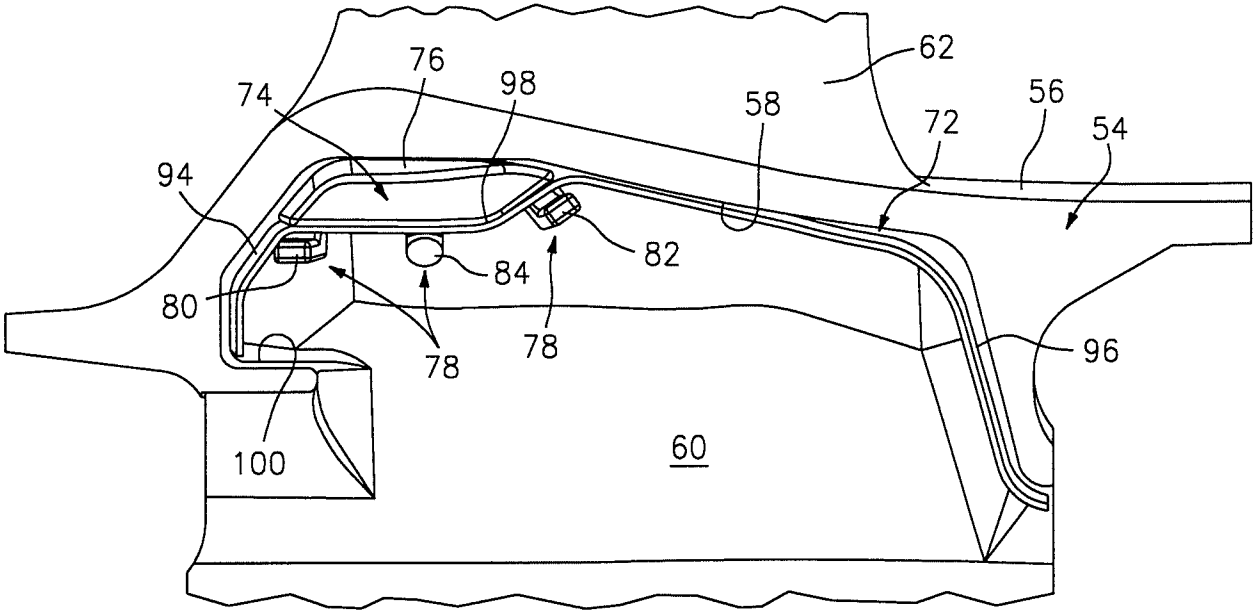
FIG. 3 is a side view of the damper seal assembly within a cavity.

With reference to FIG. 3, a damper-seal assembly 70 includes a seal 72 that minimize secondary airflow leakage through the gap 64 and a damper 74 to damp vibrations. The damper-seal assembly 70 is positioned at least partially within the cavity 60 formed between each two adjacent turbine blades 50 to abut respective the underplatform surfaces 58.

The damper-seal assembly 70 is assembled within the cavity 60 of the turbine blade 50 such that frictional contact between the damper 74 and the underplatform surface 58 absorbs and dissipates vibrational energy generated during engine operation. That is, the damper 74 is placed under centrifugal loading against the underplatform surface 58.

When a ratio between airfoil tip deflections and platform deflections is relatively high, the damper 74 should be placed as close as possible to the underplatform surface 58. With a high lift airfoil and a high tip to platform deflection ratio, the greater the damper 74 surface area in contact with the underplatform surface 58, the stiffer the interface and thus the greater the vibration-dampening performance as the more effectively the platform 54 is dampened, the more effectively the airfoil 62 is dampened. Although the damper 74 is shown in a forward position, it should be appreciated that other positions of the damper 74 may alternatively or additionally be utilized.

Figure 4:
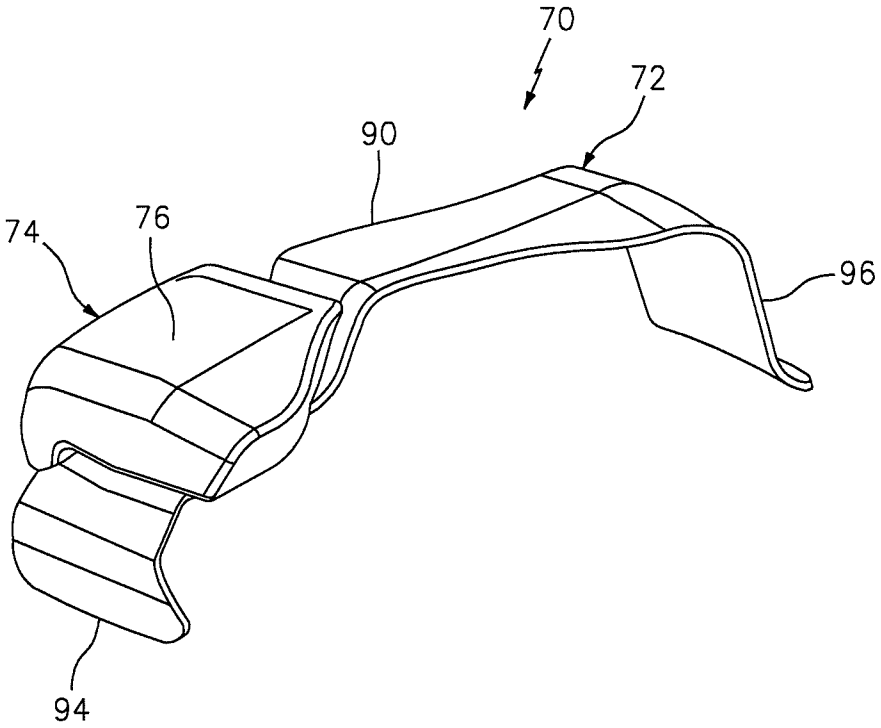
FIG. 4 is a top perspective view of the damper seal assembly.

The damper 74 generally includes a smooth continuous platform rub surface 76 (also shown in FIG. 4), and a multiple of retention features 78 opposite thereto. The damper 74 is fabricated from a material that essentially does not plastically deform under the thermal and centrifugal loads produced during engine operation to provide a dense rigid structure to absorb vibrational energy. Further, the material utilized for the damper 74 is selected to provide desired vibration dampening properties in addition to the thermal capacity.

Figure 5:
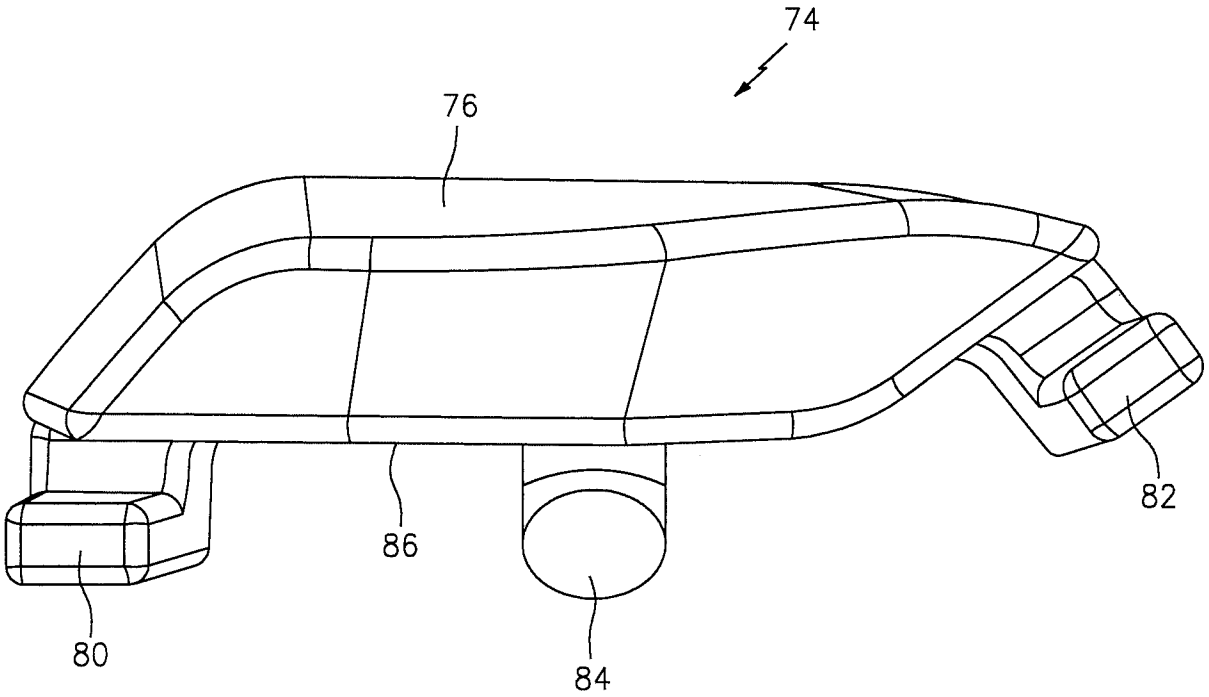
FIG. 5 is a side view of the damper according to one disclosed non-limiting embodiment.
Figure 6:
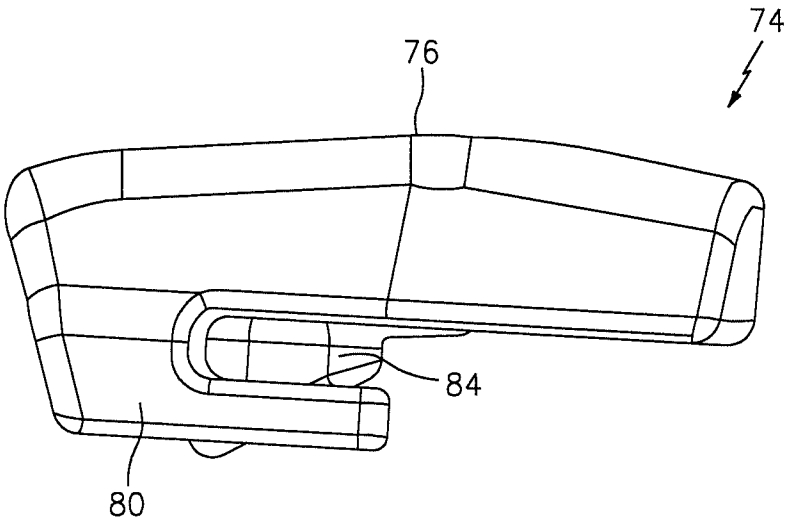
FIG. 6 is a front view of the damper according to one disclosed non-limiting embodiment.
Figure 7:
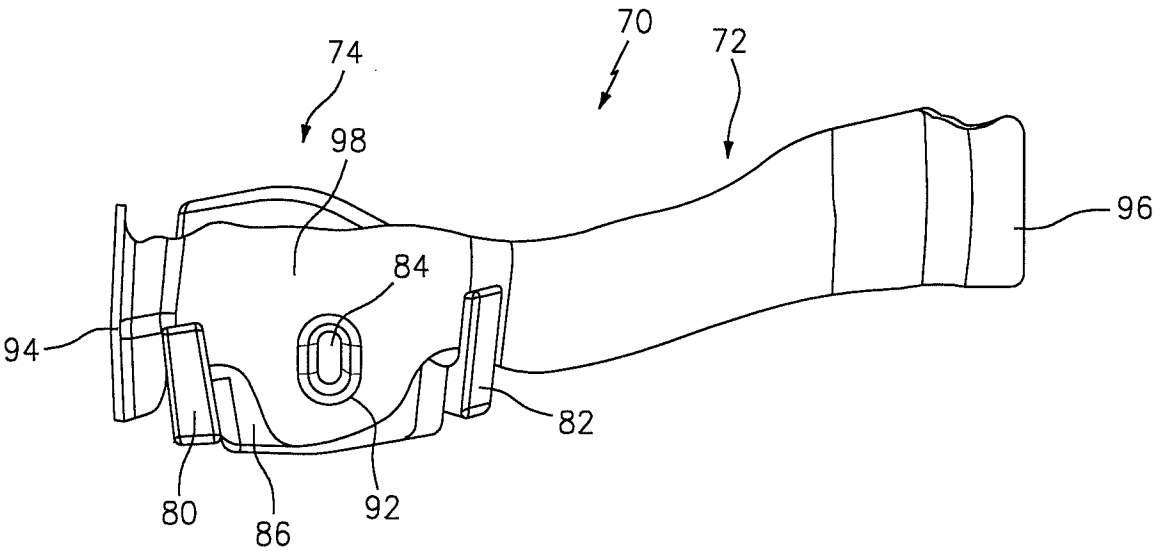
FIG. 7 is a bottom perspective view of the damper seal assembly.

In one disclosed non-limiting embodiment, the retention features 78 include a forward tang 80, an aft tang 82 and a nub 84 therebetween (also shown in FIG. 5). The forward tang 80, the aft tang 82 and the nub 84 extend from a damper undersurface 86 opposite the platform rub surface 76. The forward tang 80 and the aft tang 80 are essentially L-shaped members (see FIG. 6) to engage from one edge 90 of the seal 72 while the nub 84 is mounted into an aperture 92 of the seal 72 (see FIG. 7).

The seal 72 is radially supported by the tangs 80, 82 and axially and tangentially by the nub 84. When the seal 72 is assembled to the damper 74, the retention features 78 retain the seal 72 to the damper 74 and facilitate constraint of the damper-seal assembly 70 within the cavity 60. The platform rub surface 76 is thereby located directly adjacent and in contact with the underplatform surface 58.

With continued reference to FIG. 3, the seal 72 may be manufactured of a relatively thin sheet of metal that includes a forward portion 94 and an aft portion 96. The material utilized for the seal 72 is selected to withstand the pressures and temperatures associated with a specific application and may allow some plastic deformation responsive to the thermal and centrifugal loads to conform and fit the contours of the underplatform surface 58. The plastic deformation facilitates a desired seal between adjacent turbine blades 50.

The forward portion 94 may be at least partially supported on a ledge 100 of the cavity 60. The aft portion 96 of the seal 72 extends axially rearward and inboard to conform with the underplatform surface 58. That is, the forward portion 94 and the aft portion 96 conforms to the underplatform surface 58 of each two adjacent turbine blades 50 to bridge the gap 64.

The seal 72 further includes a damper interface portion 98 between the forward portion 94 and the aft portion 96. The damper interface portion 98 extends along the damper undersurface 86. The platform rub surface 76, the forward portion 94 and the aft portion 96 seals with the underplatform surface 58. That is, the damper interface portion 98 of the seal 72 is displaced from the underplatform surface 58 and the platform rub surface 76 is in frictional contact with the underplatform surface 58 to increase stiffness and dampen vibrations.

The damper-seal assembly 70 provides for a high stiffness damper 74 to be located directly on the underplatform surface 58 yet still provide an effective seal between adjacent blades 50. The retention feature 78 also facilitates assembly of the damper 74 and the seal 72 prior to assembly into the cavity 60 to reduce assembly errors. Further, usage of the damper 74 to constrain the seal 72 permits potential removal of retention features from within the cavity 60 which are often in high stress areas and may be susceptible to stress corrosion cracking.

Figure 8:
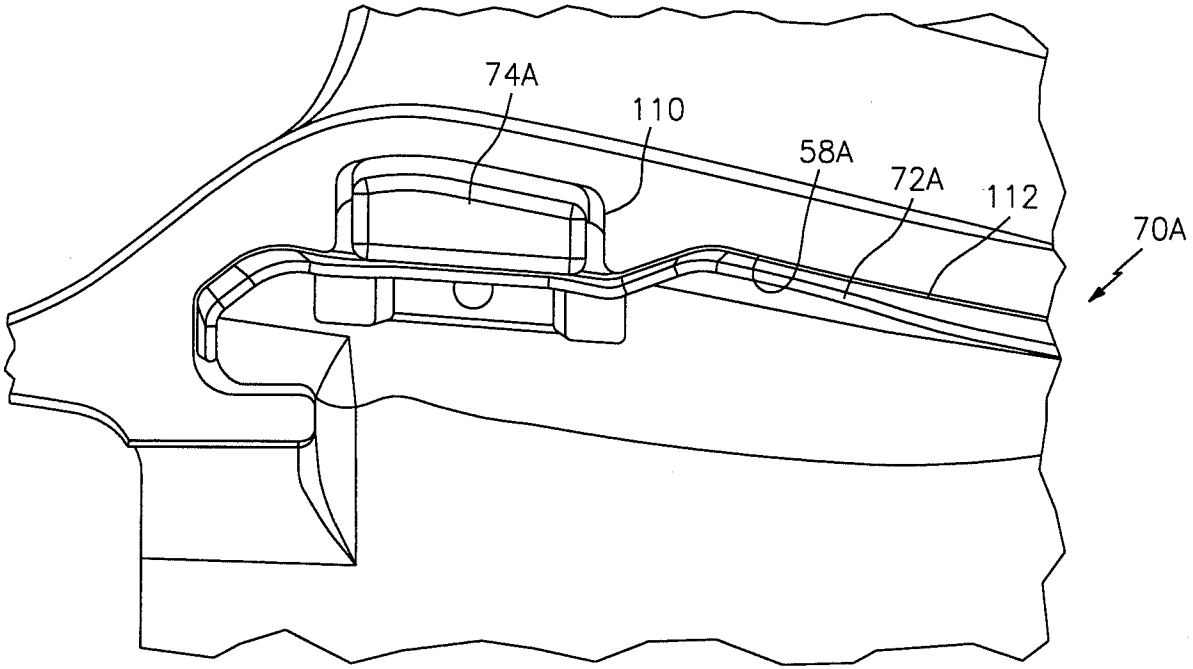
FIG. 8 is a perspective view of a damper seal assembly according to another disclosed non-limiting embodiment.

With reference to FIG. 8, a damper-seal assembly 70A according to another disclosed non-limiting embodiment includes a damper 74A at least partially recessed into a pocket 110 within the underplatform surface 58A. That is, the pocket 110 extends beyond a seal interface surface 112 between the seal 72A and the underplatform surface 58A. It should be appreciated that various other interfaces may be provided.

The use of the terms "a" and "an" and "the" and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

The foregoing description is exemplary rather than defined by the features within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. A turbine assembly, comprising:

a first turbine blade circumferentially adjacent to a second turbine blade, the first turbine blade including a first platform with a first underplatform surface, the second turbine blade including a second platform with a second underplatform surface, and the first underplatform surface and the second underplatform surface at least partially defines a cavity;

a damper with a platform rub surface adjacent the first underplatform surface and the second underplatform surface; and a seal with a forward portion, an aft portion, and a damper interface portion therebetween, the damper interface portion extending along a damper underside and the forward portion and the aft portion adjacent the first underplatform surface and the second underplatform surface, wherein the damper includes a multiple of retention features opposite the platform rub surface, and the seal is engaged with the multiple of retention features, and wherein the multiple of retention features includes a nub and a forward tang and an aft tang that engaged an edge of the seal.

2. The turbine assembly as recited in claim 1, wherein the seal includes an aperture to receive the nub.

3. The turbine assembly as recited in claim 1, wherein the forward portion is at least partially supported on a ledge defined within the cavity.

4. The turbine assembly as recited in claim 3, wherein the aft portion extends axially rearward and inboard to conform with the first underplatform surface and the second underplatform surface.

5. A method of assembling a first turbine blade circumferentially adjacent to a second turbine blade, the first turbine blade including a first platform with a first underplatform surface, the second turbine blade including a second platform with a second underplatform surface, and the first underplatform surface and the second underplatform surface at least partially defining a cavity, the method comprising:

positioning a damper with a continuous platform rub surface adjacent to the first underplatform surface and the second underplatform surface such that the damper is between a seal and the first underplatform surface and the second underplatform surface;

contacting a forward portion and an aft portion of the seal with the first underplatform surface and the second underplatform surface; and retaining a damper interface portion between the forward portion and the aft portion of the seal to the damper, wherein the damper interface portion is not in contact with the first underplatform surface and the second underplatform surface.

6. The method as recited in claim 5, wherein the damper includes a multiple of retention features, the method further comprising retaining by the multiple of retention features the seal to the damper.

7. The method as recited in claim 5, further comprising axially retaining the seal to the damper.

8. The method as recited in claim 5, further comprising contacting the continuous platform with the first underplatform surface and the second underplatform surface.

* * * * *